US007282172B2

(12) United States Patent
Hugens, Jr. et al.

(10) Patent No.: US 7,282,172 B2
(45) Date of Patent: Oct. 16, 2007

(54) VERTICAL SHAFT MELTING FURNACE

(75) Inventors: John R. Hugens, Jr., Suwanee, GA (US); Thomas F. Robertson, Medina Township, OH (US); John N. Newby, Lexington, KY (US)

(73) Assignee: North American Manufacturing Company, Cleveland, OH (US)

( * ) Notice: Subject to any disclaimer, the term of this patent is extended or adjusted under 35 U.S.C. 154(b) by 440 days.

(21) Appl. No.: 10/766,163

(22) Filed: Jan. 28, 2004

(65) Prior Publication Data

US 2005/0161868 A1 Jul. 28, 2005

(51) Int. Cl.
*C21B 7/16* (2006.01)

(52) U.S. Cl. ..... 266/197; 266/266

(58) Field of Classification Search ..... 266/197, 266/265, 268

See application file for complete search history.

(56) References Cited

U.S. PATENT DOCUMENTS

| | | | | |
|---|---|---|---|---|
| 471,618 | A | 3/1892 | Leede | |
| 865,659 | A | 9/1907 | Scott | |
| 1,640,251 | A * | 8/1927 | Poumay | 266/197 |
| 1,799,643 | A * | 4/1931 | Rogers | 266/197 |
| 1,834,630 | A | 12/1931 | Meloche | |
| 2,474,504 | A | 6/1949 | West | |
| 3,547,624 | A | 12/1970 | Gray | |
| 3,603,571 | A * | 9/1971 | Geiger et al. | 266/197 |
| 3,838,974 | A | 10/1974 | Hemsath et al. | |
| 4,111,687 | A | 9/1978 | Syska | |
| 4,116,611 | A | 9/1978 | Syska | |
| 4,129,742 | A | 12/1978 | Ward | |
| 4,211,555 | A | 7/1980 | Berry et al. | |
| 4,243,209 | A | 1/1981 | Pariani et al. | |
| 4,301,997 | A | 11/1981 | Berry et al. | |
| 4,309,170 | A | 1/1982 | Ward | |
| 4,311,519 | A | 1/1982 | Berry | |
| 4,315,775 | A | 2/1982 | Odle et al. | |
| 4,402,740 | A | 9/1983 | Arp et al. | |
| 4,403,951 | A | 9/1983 | Beckenbach et al. | |
| 4,452,585 | A | 6/1984 | Arp | |

(Continued)

*Primary Examiner*—Scott Kastler
(74) *Attorney, Agent, or Firm*—Jones Day

(57) ABSTRACT

A vertical shaft melting furnace is operated in a method that includes firing a plurality of burners to generate combustion products, and directing jets of the combustion products into the shaft in a bottom region of the shaft. The method further includes directing a jet of hot gas into the shaft in an upper region of the shaft in a non-radial direction, whereby the jet of hot gas can induce a swirl to disperse a concentrated channel of combustion products rising from the bottom region to the upper region through a void in unmelted portions of a load of metal pieces in the shaft. The jet of hot gas directed into the upper region of the shaft can include recirculated flue gas, a mixture of air and recirculated flue gas, or combustion products that are generated by a burner. If the jet of hot gas includes combustion products that are generated by a burner, the burner is a secondary burner that preferably is fired into the shaft with a relatively low heat input. In each case, the jet of hot gas preferably is one of a plurality of jets of hot gas that are directed into the shaft in the upper region of the shaft, and preferably at an uppermost level, in non-radial directions that together extend in a common direction circumferentially around the inside of the shaft.

15 Claims, 5 Drawing Sheets

U.S. PATENT DOCUMENTS

| | | | |
|---|---|---|---|
| 4,536,152 | A | 8/1985 | Little, Jr. et al. |
| 4,556,418 | A | 12/1985 | Syska |
| 4,664,702 | A | 5/1987 | Barnes et al. |
| 4,844,426 | A | 7/1989 | Barnes et al. |
| 4,959,102 | A | 9/1990 | Clarkson et al. |
| 5,196,155 | A | 3/1993 | Askin et al. |
| 5,209,893 | A | 5/1993 | Askin et al. |
| 5,397,109 | A | 3/1995 | Wilson et al. |
| 5,411,393 | A | 5/1995 | Askin et al. |
| 5,518,524 | A | 5/1996 | Wilson et al. |
| 6,113,386 | A | 9/2000 | Shannon et al. |
| 6,524,356 | B2 | 2/2003 | Fournier et al. |

* cited by examiner

VERTICAL SHAFT MELTING FURNACE

TECHNICAL FIELD

This technology relates to furnaces for melting scrap and refined metal shapes.

BACKGROUND

A vertical shaft melting furnace is a particular type of furnace that is used to melt scrap and refined metal shapes. Pieces of metal are dropped into the furnace shaft to form a load of pieces that are stacked upon one another in the shaft. Burners fire into the shaft to melt the load of metal pieces, and the molten metal drains outward through an outlet at the bottom of the shaft.

SUMMARY

The claimed invention includes a method of operating a vertical shaft melting furnace. The furnace is operated by firing a plurality of burners to generate combustion products, and by directing jets of the combustion products into the shaft in a bottom region of the shaft. Additionally, a jet of hot gas is directed into the shaft in an upper region of the shaft in a non-radial direction. The non-radial jet of hot gas can induce a swirl to disperse a concentrated channel of combustion products rising from the bottom region to the upper region through a void in unmelted portions of a load of metal pieces in the shaft.

The non-radial jet of hot gas that is directed into the upper region of the shaft may comprise recirculated flue gas, a mixture of air and recirculated flue gas, or combustion products that are generated by a burner. If the non-radial jet of hot gas comprises combustion products that are generated by a burner, the burner is preferably fired into the shaft with a relatively low heat input. In each case, it is preferable to direct multiple jets of hot gas into the shaft in the upper region of the shaft in non-radial directions, with the non-radial directions together extending in a common direction circumferentially around the inside of the shaft.

Summarized differently, the invention includes a method of operating a vertical shaft melting furnace by firing a plurality of burners to generate combustion products, and by directing jets of the combustion products into the shaft at a plurality of vertically spaced levels. A jet of combustion products at the uppermost level is directed into the shaft in a non-radial direction to induce the swirl.

The invention also includes an apparatus for performing the method. The apparatus may comprise parts of a newly constructed furnace or a retrofitted furnace. Accordingly, the invention further includes a method of retrofitting a furnace by rendering it operative to perform the method.

DESCRIPTION

Figure 1:
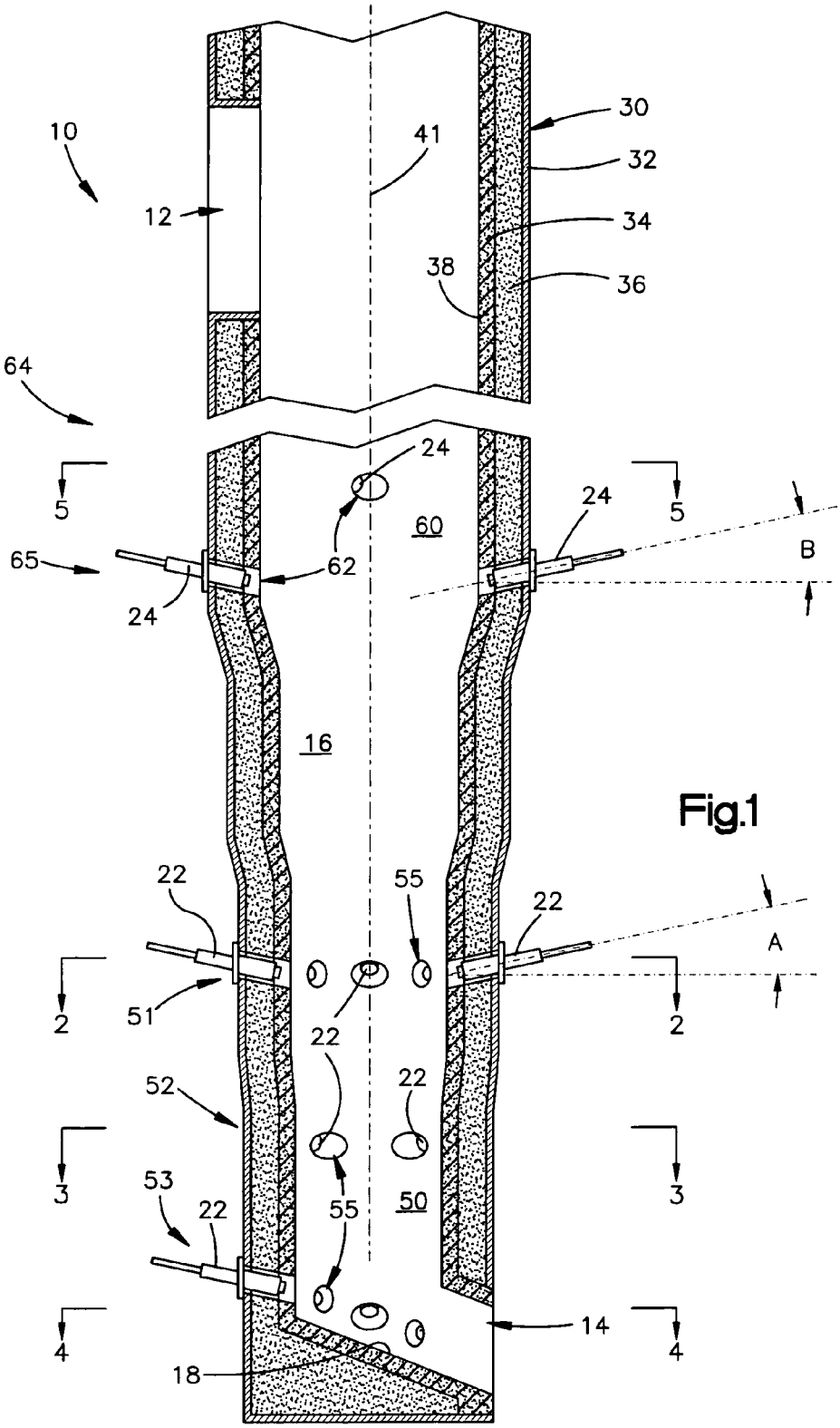
FIG. 1 is a schematic view of parts of a vertical shaft melting furnace.

The apparatus 10 shown schematically in FIG. 1 has parts that are examples of the parts recited as elements of the claims that follow.

This apparatus 10 is a vertical shaft melting furnace with an inlet 12, an outlet 14, and a shaft 16 extending vertically downward from the inlet 12 to the outlet 14. A hearth 18 is located at the bottom of the shaft 16 beside the outlet 14, and is inclined toward the outlet 14. The furnace 10 has a flue (not shown) at the upper end of the shaft 16, and has burners 22 and 24 that fire into the shaft 16 between the inlet 12 and the outlet 14. Metal pieces are dropped into the shaft 16 through the inlet 12, and are stacked upward from the hearth 18 to form an irregularly shaped load with a height that reaches upward past the burners 22 and 24 to the inlet 12. Molten metal drops to the hearth 18 and flows from the hearth 18 through the outlet 14 as the load of metal pieces is melted in the shaft 16.

The furnace wall structure 30 shown schematically in FIG. 1 has an outer layer 32 formed of steel, and has first and second inner layers 34 and 36 formed of refractory material. Other layers could be included, as known to those skilled in the art, but are omitted from the drawings for clarity of illustration. A cylindrical inner surface 38 of the first inner layer 34 defines the size and shape of the shaft 16 vertically between the inlet 12 and the hearth 18. The diameter of the inner surface 38 preferably decreases intermittently downward toward the hearth 18 to provide the shaft 16 with a tapered cylindrical configuration centered on a vertical axis 41, as shown by way of example in FIG. 1.

The burners 22 and 24 include primary burners 22 and secondary burners 24. As shown in FIG. 1, the primary burners 22 are arranged to fire into the shaft 16 in a bottom region 50 of the shaft 16 that extends upward from the hearth 18. Specifically, three circular rows 51, 52 and 53 of primary burner ports 55 extend through the furnace wall structure 30 beside the bottom region 50 of the shaft 16. These three rows 51, 52 and 53 are spaced apart from each other vertically along the height of the shaft 16, and thus include an upper row 51, a middle row 52, and a lower row 53. The three rows 51, 52 and 53 of primary burner ports 55 contain three corresponding rows of primary burners 22.

Figure 2:
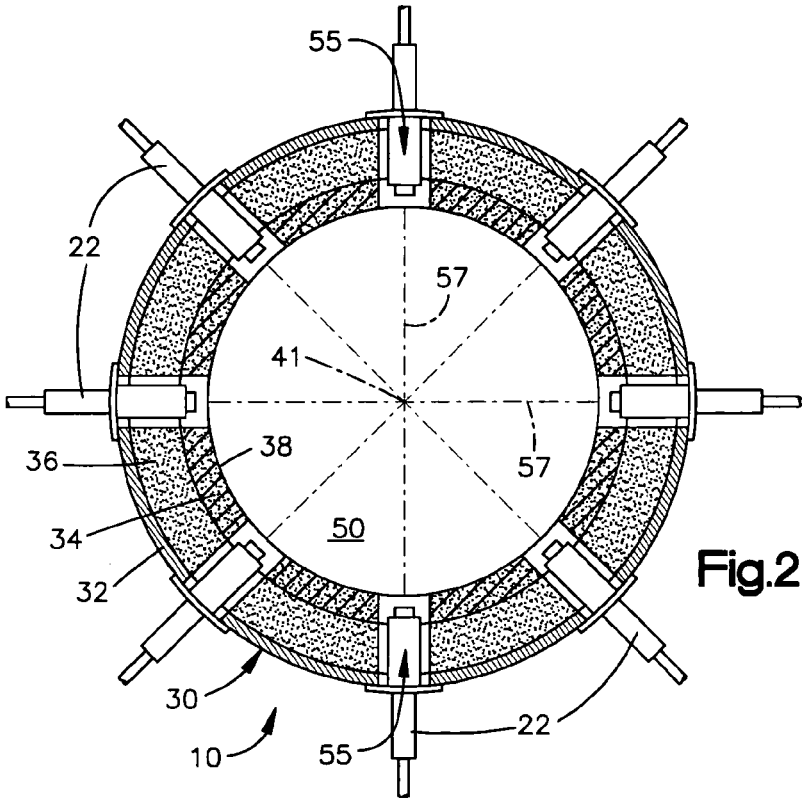
FIG. 2 is a view taken approximately on line 2-2 of FIG. 1.

As best shown in FIG. 2, the ports 55 in the upper row 51 are uniformly spaced apart from each other circumferentially around the axis 41 and are configured as cylindrical passages with longitudinal centerlines 57 that meet at the axis 41. Each centerline 57 is inclined from horizontal at an angle A (FIG. 1) which is preferably about 15°. A primary burner 22 is mounted in each port 55 in the upper row 51 to fire into the shaft 16 along the corresponding centerline 57. Each of these primary burners 22 is thus mounted on the furnace wall structure 30 to fire into the bottom region 50 of the shaft 16 in a radial direction that is inclined downward.

Figure 3:
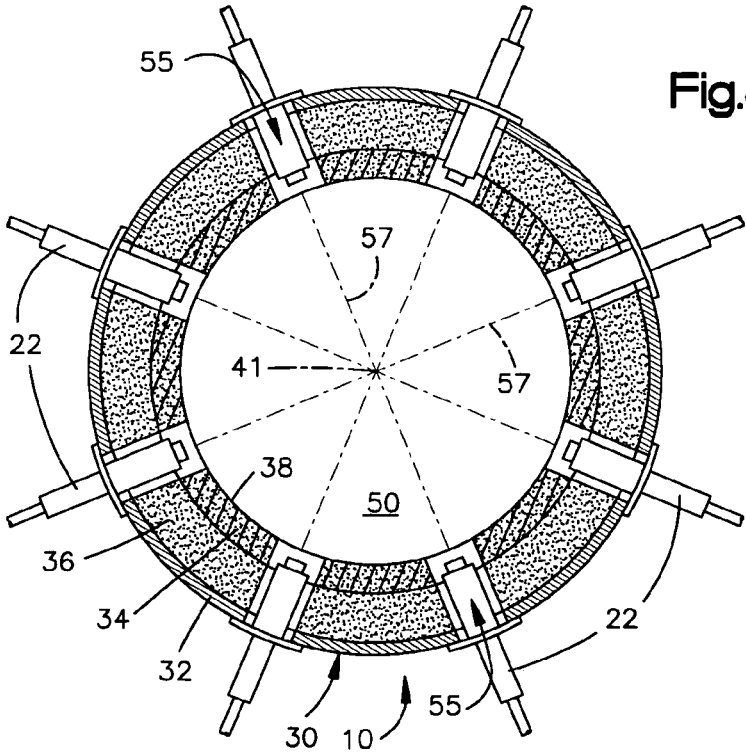
FIG. 3 is a view taken approximately on line 3-3 of FIG. 1.

The ports 55 and burners 22 in the middle row 52 also are arranged in the furnace wall structure 30 in the manner described above, but are offset from the upper row 51 circumferentially about the axis 41. This is best shown in FIG. 3. In this particular example, they are offset by 22.5° so that the sixteen primary burners 22 in these two rows 51 and 52 are uniformly staggered circumferentially about the axis 41.

Figure 4:
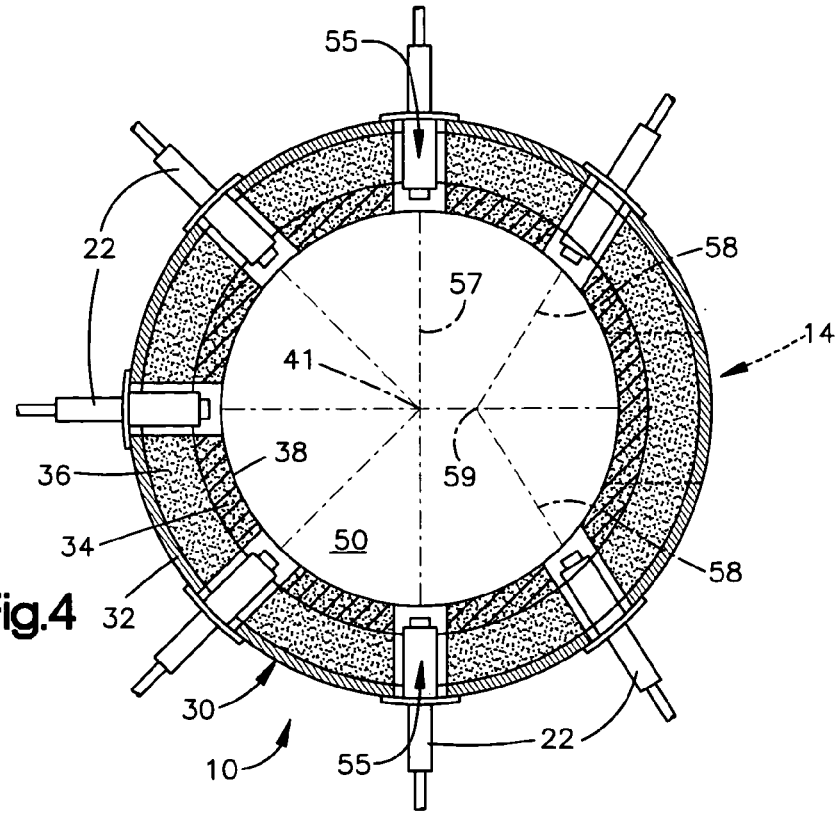
FIG. 4 is a view taken approximately on line 4-4 of FIG. 1.

The lower row 53 of ports 55 and burners 22 is circumferentially offset from the middle row 52 in the same manner that the middle row 52 is circumferentially offset from the upper row 51. Like the primary burners 22 in the other two rows 51 and 52, each primary burner 22 in the lower row 53 is inclined at about 15° downward from horizontal. As shown in FIG. 1, the lower row 53 extends around the periphery of the hearth 18 and is inclined with the hearth 18 downward toward the outlet 14. As shown in FIG. 4, the perimeter of the lower row 53 extends across the location of the outlet 14, and a port/burner arrangement 55, 22 is omitted from the lower row 53 at that location. Accordingly, the two port/burner arrangements 55, 22 next to the outlet 14 are oriented for those two burners 22 to fire into the shaft 16 in directions that extend more closely toward the outlet 14. In this particular example, they have centerlines 58 that intersect a vertical axis 59 that is spaced from the central axis 41 in a direction radially toward the outlet 14. This helps to ensure that sufficient heat is provided near the outlet 14. All of the primary burners 22, which are shown schematically in the drawings, are premix burners with structural details that are well known to a person of ordinary skill in the art, and can be attached to the furnace wall structure 30 in any suitable manner known in the art.

The secondary burners 24, which also are shown schematically in the drawings, likewise can be attached to the furnace wall structure 30 in any suitable manner known in the art.

Although the secondary burners 24 and the primary burners 22 can be alike, as illustrated schematically in the drawings, the secondary burners 24 preferably are nozzle mix burners rather than premix burners. The structural details of nozzle mix burners also are well known to a person of ordinary skill in the art.

As shown in FIG. 1, the secondary burners 24 are arranged to fire into the shaft 16 in an upper region 60 of the shaft 16 that is located vertically between the bottom region 50 and the inlet 12. Ports 62 for the secondary burners 24 extend through the furnace wall structure 30 beside the upper region 60 of the shaft 16, and are arranged in two rows 64 and 65 that are vertically spaced apart from each other. In this particular example, each row 64 and 65 includes only a pair of ports 62. The ports 62 in each pair have diametrically opposed locations, as best shown in FIG. 5, and are configured as cylindrical passages with longitudinal centerlines 67.

Each centerline 67 is inclined from horizontal at an angle B (FIG. 1) which also is preferably about 15°. As shown in FIG. 5 with reference to the uppermost row 64 of burners 24, the centerlines 67 do not extend radially into the shaft 16. Instead, each centerline 67 is skewed from a radial direction at an angle C which is preferably about 52°. Each secondary burner 24 is thus mounted on the furnace wall structure 30 to fire into the upper region 60 of the shaft 16 in a non-radial direction that is inclined downward.

Figure 5:
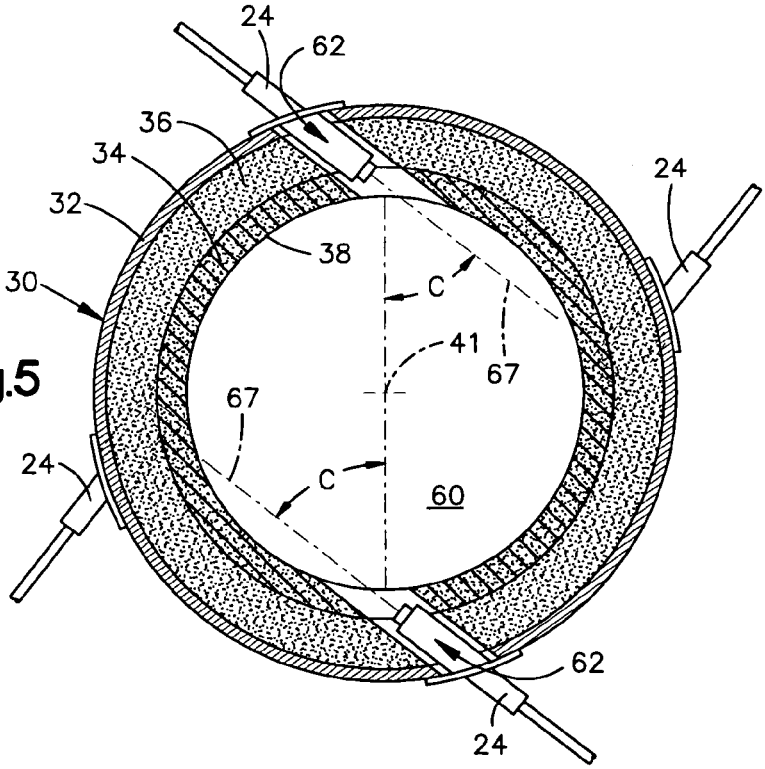
FIG. 5 is a view taken approximately on line 5-5 of FIG. 1.

In the arrangement shown by way of example in FIG. 5, the two secondary burners 24 in each diametrically opposed pair are skewed equally and oppositely relative to each other so as to fire into the shaft 16 in directions that are opposite and parallel to each other when viewed from above. Additionally, each pair of secondary burners 24 is offset 90° about the central axis 41 from the other pair such that the four secondary burners 24 fire into the shaft 16 in non-radial directions that together extend around the inside of the shaft 16 in a common circumferential direction. In the illustrated example, that direction is clockwise, as viewed from above in FIG. 5.

Figure 6:
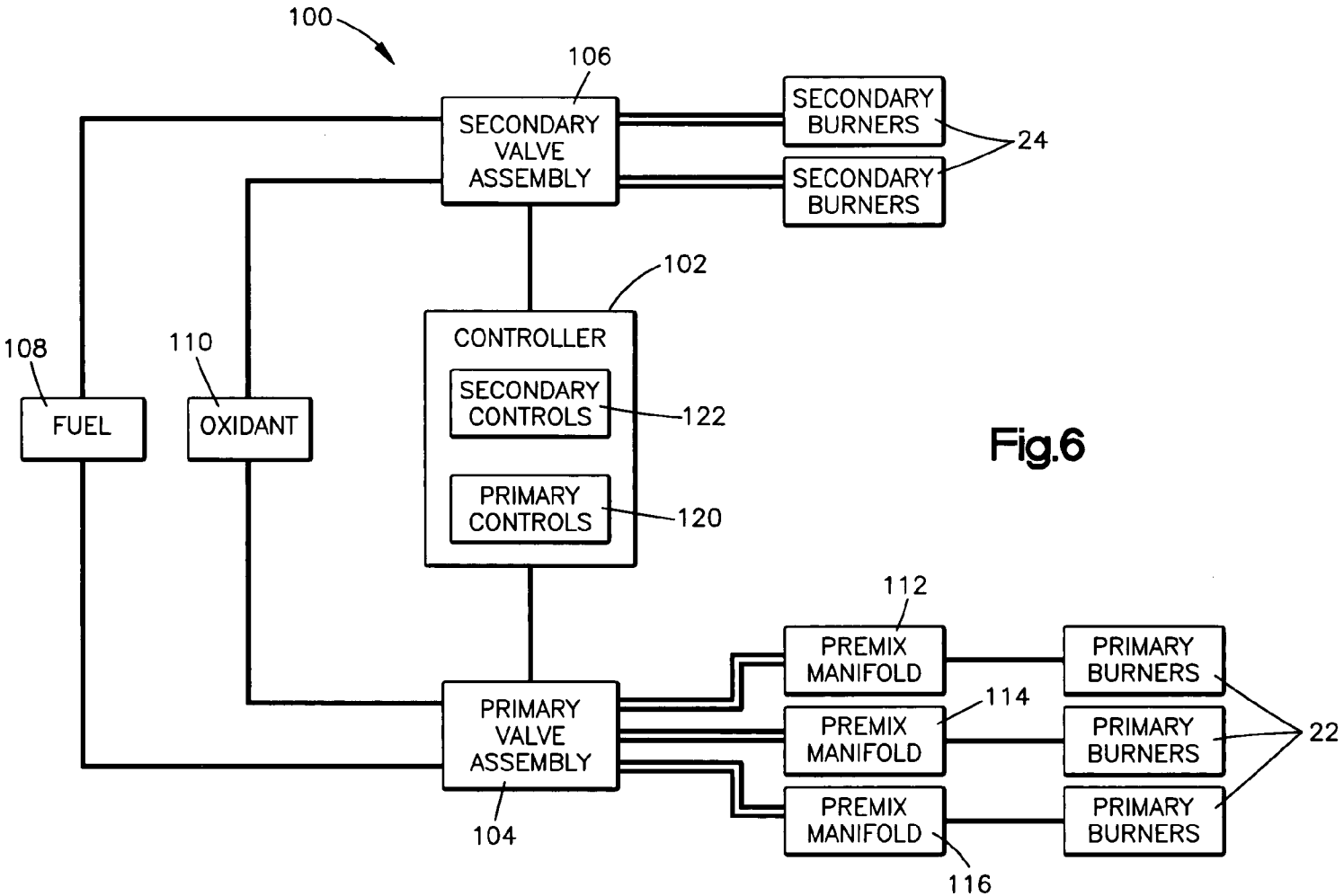
FIG. 6 is a block diagram of parts of the vertical shaft melting furnace.

The burners 22 and 24 of FIGS. 1-5 are interconnected in the reactant supply and control system 100 of FIG. 6. This system 100 includes a controller 102, a primary valve assembly 104, and a secondary valve assembly 106. Also included are sources 108 and 110 of fuel and oxidant. The fuel preferably is natural gas, and the oxidant preferably is atmospheric air.

The primary valve assembly 104 is operative to communicate the fuel and oxidant sources 108 and 110 with the primary burners 22 at the furnace wall structure 30. As noted above, the primary burners 22 are premix burners. The primary valve assembly 104 includes valves that are operative to provide and regulate separate flows of fuel and oxidant to each of the three rows of primary burners 22. These flows are directed through three corresponding premix manifolds 112, 114 and 116 in which the fuel and oxidant are mixed for the formation of premix upstream of the primary burners 22. The secondary valve assembly 106 similarly includes valves that are operative to provide and regulate separate flows of fuel and oxidant from the sources 108 and 110 to each of the two pairs of secondary burners 24, which are nozzle mix burners.

The controller 102 includes primary controls in the form of hardware and/or software 120 for operation of the primary valve assembly 104. The controller 102 further includes secondary controls in the form of hardware and/or software 122 for operation of the secondary valve assembly 106. As the controller 102 carries out those instructions, the valve assemblies 104 and 106 are directed to provide the burners 22 and 24 with flows of fuel and oxidant in ratios such that the burners 22 and 24 will fire into the shaft 16 with heat inputs that are controlled with reference to the particular melting process to be performed by the furnace 10.

The load of metal pieces in the shaft 16 will typically have one or more voids extending vertically through the load between the various metal pieces. Such voids could result from the configuration of the unmelted load, and/or could be created by the passage of hot combustion products vertically upward through the load. When the primary burners 22 fire into the bottom region 50 of the shaft 16, they generate and direct jets of primary combustion products from the burner ports 55 into the shaft 16 in the directions indicated in FIGS. 2, 3 and 4. As the jets of primary combustion products impinge upon the irregularly shaped load of metal pieces, concentrated channels of the primary combustion products can form and rise through the voids defined by and between the metal pieces of the load and/or the load and the surrounding inner surface 38 of the furnace wall structure 30. However, the secondary burners 24 fire upper jets of secondary combustion products into the upper region 60 of the shaft 16 to disperse the concentrated channels of primary combustion products rising to the upper region 60 through the voids. The non-radial firing direction of each secondary burner 24 enables the corresponding jet of secondary combustion products to swirl around the inside of the shaft 16 as it is deflected by the load and the cylindrical inner wall surface 38. The swirl in the secondary combustion products helps to disperse the concentrated channels of primary combustion products. The common circumferential firing directions of the two secondary burners 24 in each pair, and of the two pairs, imparts uniformity and greater momentum to the swirling secondary combustion products, with a correspondingly greater dispersal of the primary combustion products. By dispersing the vertical channels of primary combustion products in this manner, each secondary burner 24 promotes more uniform heating of the load above the primary burners 22, and also increases the residence time and mean travel path for the primary combustion products to supply heat to the load before rising from the load toward the flue at the upper end of the shaft 16.

Each primary burner 22 is preferably fired into the shaft 16 with a first individual heat input, and each secondary burner 24 is preferably fired into the shaft 16 with a second, lower individual heat input. This enables the secondary burners 24 to disperse concentrated channels of combustion products rising from the primary burners 22, and to provide heat so as not to cool the primary combustion products in an amount that would detract from the melting process. The relatively low heat input is preferably accomplished by the use of nozzle mix burners rather than premix burners in the upper region 60 of the shaft 16. Alternatively, premix burners could be fired into the upper region 60 of the shaft 16 as non-radial burners with fuel and oxidant flows that provide lower individual heat inputs under the influence of the controller 102.

The furnace 10 described above could be a newly constructed furnace or a pre-existing furnace that is retrofitted. Retrofitting of this example of a furnace 10 would include formation of the secondary burner ports 62 in the furnace wall structure 30, with installation of the secondary burners 24 in the secondary ports 62. Retrofitting of this furnace 10 would further include installation of the secondary valve assembly 106 in the reactant supply and control system 100, along with the addition of the secondary controls 122, either by reprogramming or otherwise modifying a pre-existing controller to perform the secondary control function, or by replacing a pre-existing controller with the controller 102 described above.

Figure 7:
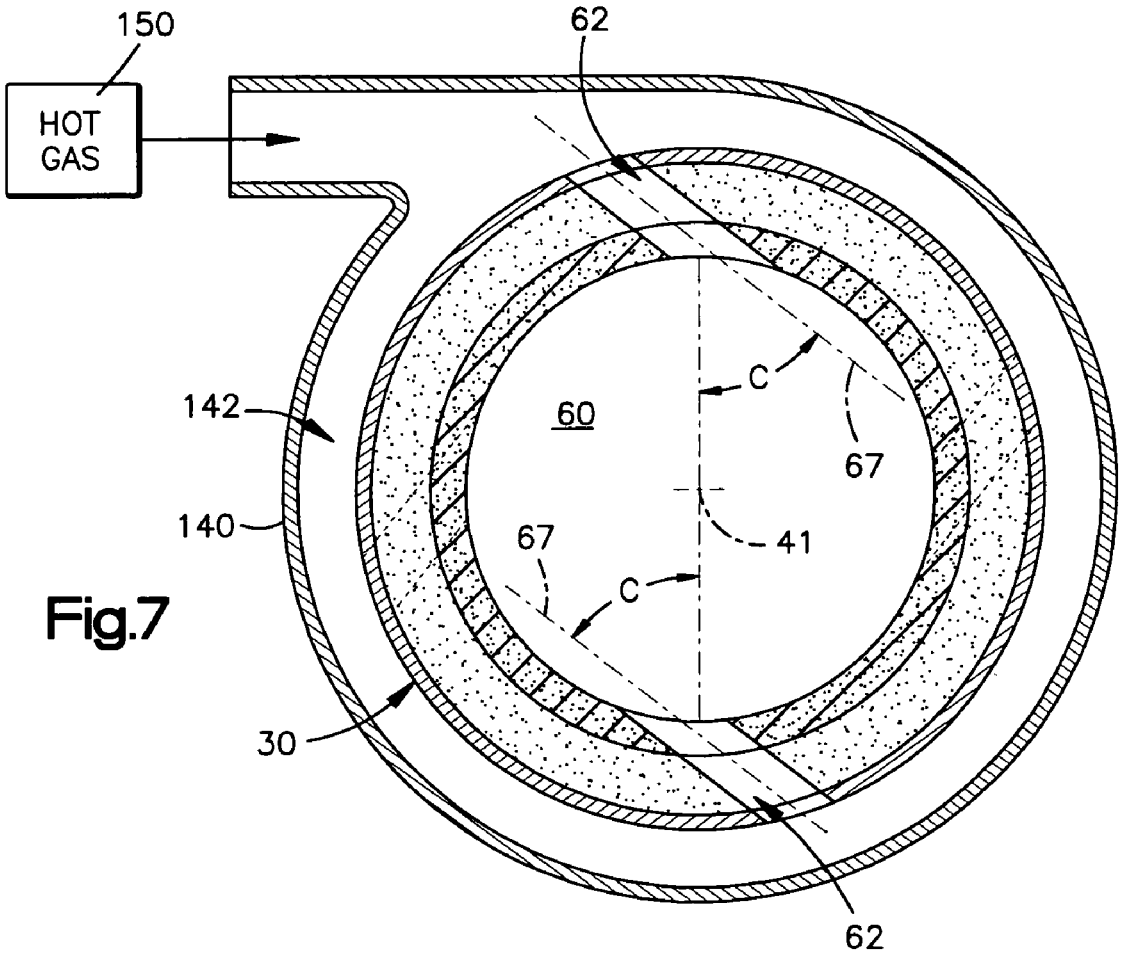
FIG. 7 is a view similar to FIG. 5 showing alternative parts of a vertical shaft melting furnace.

FIG. 7 shows a swirl-inducing structure that can be used as an alternative to either or both of the rows of secondary burners 24 that are shown in FIG. 5. The arrangement of FIG. 7 does not include secondary burners in the secondary burner ports 62. Instead, this arrangement includes a duct structure 140 defining a plenum 142 that surrounds the ports 62 at the outside of the furnace wall structure 30. A source 150 of hot gas is operative to direct a jet of hot gas into the plenum 142. The ports 62 direct multiple jets of the hot gas from the plenum 142 into the upper region 60 of the shaft 16 in the same downwardly-inclined, non-radial directions described above with reference to FIG. 5.

The hot gas from the source 150 could be recirculated flue gas, a combination of atmospheric air and recirculated flue gas, or combustion products generated by a secondary burner like the secondary burners 24 described above. The use of a plenum 142 to communicate the upper ports 62 with a source of hot gas could be a feature of a newly constructed furnace, but may be especially suitable for retrofitting an existing furnace in which access for installation of burners is limited.

This written description sets forth the best mode of carrying out the invention, and describes the invention to enable a person of ordinary skill in the art to make and use the invention, by presenting examples of the elements recited in the claims. The patentable scope of the invention is defined by the claims, and may include other examples that occur to those skilled in the art. In this regard, the description of a controller is meant to include any suitable control device or combination of control devices that can be programmed or otherwise arranged to perform as recited in the claims. Such other examples, which may be available either before or after the application filing date, are intended to be within the scope of the claims if they have structural or process elements that do not differ from the literal language of the claims, or if they have equivalent structural or process elements with insubstantial differences from the literal language of the claims.

The invention claimed is:

1. An apparatus for use in a vertical shaft melting furnace having a shaft configured to receive stacked metal pieces that together comprise a load that may have a vertically extending void, and further having a plurality of burners that are configured to fire into the shaft in a bottom region of the shaft, the apparatus comprising:

a device that is configured to direct a jet of hot gas into the shaft in an upper region of the shaft in a non-radial direction, whereby the non-radial jet of hot gas can induce a swirl to disperse a concentrated channel of combustion products rising from the bottom region to the upper region through a void in unmelted portions of a load of stacked metal pieces in the shaft;

wherein the device is an upper burner and the non-radial jet of hot gas comprises an upper jet of combustion products generated by the upper burner, and further comprising a plenum that communicates the upper burner with the shaft such that the upper burner is configured to fire into the plenum, and multiple upper jets of combustion products are directed from the plenum into the shaft in the upper region of the shaft, when the upper burner is fired.

2. An apparatus as defined in claim 1 wherein the plenum is configured to direct the upper jets of combustion products into the upper region of the shaft in non-radial directions.

3. An apparatus as defined in claim 2 wherein the non-radial directions together extend in a common direction circumferentially around the inside of the shaft.

4. An apparatus for use in a vertical shaft melting furnace having a shaft configured to receive stacked metal pieces that together comprise a load that may have a vertically extending void, and further having a plurality of burners that are configured to fire into the shaft in a bottom region of the shaft, with each of the plurality of burners being configured to fire with a first individual heat input, the apparatus comprising:

an upper burner that is configured to fire into the shaft in an upper region of the shaft with a second, lower individual heat input, whereby the upper burner can disperse a concentrated channel of combustion products rising from the bottom region to the upper region through a void in unmelted portions of a load of stacked metal pieces in the shaft; and a plenum that communicates the upper burner with the shaft such that the upper burner is configured to fire an upper jet of combustion products into the plenum, and multiple upper jets of combustion products are directed from the plenum into the shaft in the upper region of the shaft, when the upper burner is fired.

5. An apparatus as defined in claim 4 wherein the plenum is configured to direct the upper jets of combustion products into the shaft in the upper region of the shaft in non-radial directions.

6. An apparatus as defined in claim 5 wherein the non-radial directions together extend in a common direction circumferentially around the inside of the shaft.

7. A vertical shaft melting furnace comprising:

a furnace wall structure defining a shaft configured to receive stacked metal pieces that together comprise a load that may have a vertically extending void;

a plurality of burners that are configured to fire into the shaft in a bottom region of the shaft in radial directions; and a device that is configured to direct a jet of hot gas into the shaft in an upper region of the shaft in a non-radial direction, whereby the non-radial jet of hot gas can induce a swirl to disperse a concentrated channel of combustion products rising from the bottom region to the upper region through a void in unmelted portions of a load of stacked metal pieces in the shaft.

8. A vertical shaft melting furnace as defined in claim 7 wherein the shaft is tapered radially inward from the upper region to the bottom region.

9. A vertical shaft melting furnace as defined in claim 7 wherein the plurality of burners that are configured to fire into the shaft in the bottom region of the shaft are premix burners and the device at the upper region of the shaft is a nozzle mix burner.

10. A vertical shaft melting furnace comprising:

a furnace wall structure defining a shaft configured to receive stacked metal pieces that together comprise a load that may have a vertically extending void;

a plurality of lower burners that are configured to fire into the shaft in a bottom region of the shaft in radial directions, with each of the plurality of lower burners being configured to fire with a first individual heat input;

an upper burner that is configured to fire into the shaft in an upper region of the shaft in a non-radial direction with a second, lower individual heat input, whereby the upper burner can disperse a concentrated channel of combustion products rising from the bottom region to the upper region through a void in unmelted portions of a load of stacked metal pieces in the shaft; and a control system that is configured to fire each of the lower burners with the first individual heat input and to fire the upper burner with the second, lower individual heat input.

11. A vertical shaft melting furnace as defined in claim 10 wherein the shaft is tapered radially inward from the upper region to the bottom region.

12. An apparatus as defined in claim 10 wherein the plurality of burners that are configured to fire into the bottom region of the shaft are premix burners and the upper burner is a nozzle mix burner.

13. A vertical shaft melting furnace comprising:

a furnace wall structure defining a shaft configured to receive stacked metal pieces that together comprise a load that may have a vertically extending void, the shaft having a bottom region, an upper region, and a configuration that is tapered radially inward from the upper region to the bottom region;

a plurality of burners that are configured to fire into the shaft in the bottom region of the shaft to melt the load of stacked metal pieces; and a device that is configured to direct a jet of hot gas into the shaft in an upper region of the shaft in a non-radial direction, whereby the non-radial jet of hot gas can induce a swirl to disperse a concentrated channel of combustion products rising from the bottom region to the upper region through a void in unmelted portions of a load of stacked metal pieces in the shaft.

14. A vertical shaft melting furnace as defined in claim 7 wherein the shaft is tapered such that the diameter of the shaft decreases intermittently downward in the shaft.

15. A vertical shaft melting furnace as defined in claim 7 wherein each of the plurality of burners that are configured to fire into the shaft in the bottom region of the shaft is configured to fire with a first individual heat input, the device at the upper region of the shaft is a burner that is configured to fire into the shaft with a second, lower individual heat input, and further comprising a control system that is configured to fire each of the plurality of burners with the first individual heat input and to fire the device with the second, lower individual heat input.

* * * * *